United States Patent [19]

Asami

[11] Patent Number: 4,912,029

[45] Date of Patent: Mar. 27, 1990

[54] SILVER HALIDE PHOTOGRAPHIC MATERIALS

[75] Inventor: Masahiro Asami, Kanagawa, Japan

[73] Assignee: Fuji Photo Film Co., Ltd., Kanagawa, Japan

[21] Appl. No.: 193,606

[22] Filed: May 13, 1988

[30] Foreign Application Priority Data

May 15, 1987 [JP] Japan ..... 62-118520

[51] Int. Cl.[4] ..... G03C 1/02

[52] U.S. Cl. ..... 430/567; 430/564

[58] Field of Search ..... 430/567, 564

[56] References Cited

U.S. PATENT DOCUMENTS 4,564,591 1/1986 Tanaka et al. ..... 430/567

4,581,328 4/1986 Matsuyama ..... 430/567

4,590,155 5/1986 Klotzer ..... 430/376

*Primary Examiner*—Hoa Van Le

*Attorney, Agent, or Firm*—Sughrue, Mion, Zinn, Macpeak & Seas

[57] ABSTRACT

Silver halide photographic materials of which the distinguishing features are that surface latent image type mono-disperse silver chlorobromide emulsions consisting of silver chlorobromide which is essentially silver iodide free, obtained by subjecting the surface of silver halide grains which have a plurality of layers which have different halogen compositions within the grains to halogen conversion, are included in at least one emulsion layer on a support.

10 Claims, No Drawings

SILVER HALIDE PHOTOGRAPHIC MATERIALS

FIELD OF THE INVENTION

This invention relates to silver halide photographic materials, and more precisely, silver halide photographic materials which have high speed and contrast and which, moreover, have excellent pressure resisting properties.

BACKGROUND OF THE INVENTION

Photographic materials in which silver halides are used are employed in a wide range of applications at the present time. In the field of photosensitive materials for printing purposes, a strong demand has arisen for faster printing and development processing operations. In fact, techniques have been developed over the years for shortening processing times and these techniques have been introduced commercially. In practical terms, these techniques have involved increasing the speed of the photosensitive materials (shortening the printing process), increasing the rate of development (shortening the development processing time) and increasing durability, with respect to scratching etc. which can occur as a result of increasing line speeds. Furthermore, stability in development processing is of importance in addition to the points indicated above.

Methods in which the amount of light absorbed per silver halide grain is increased and methods in which the efficiency of latent image formation, with respect to the quantity of light absorbed, is increased can be considered for increasing the speed of a silver halide emulsion.

It is thought that in the former case, the amount of light which is absorbed per grain can be increased by increasing the size of the silver halide grains or, in cases where the emulsion is spectrally sensitized, it is thought that the amount of light absorbed can be increased by increasing the amount of spectrally sensitizing dye. However, it is known that the rate of development often decreases when the size of the silver halide grains is increased. Furthermore, it is known that increasing the amount of spectrally sensitizing dye inhibits development or de-silvering. Hence, in most cases it is difficult to employ these methods in practice.

In the latter case, the independent or combined use of methods of sulfur sensitization, gold sensitization or reductive sensitization or other so-called chemical sensitization methods, is effective. However, these is a limit to the speeds which can be achieved using these methods. That is to say, in many cases, increased fogging and a lowering of contrast occur when short exposures are made at high brightness levels, due to excessive sensitization.

Hence it is important that the emulsion speed should be raised while holding the size of the silver halide grains constant and without invoking the adverse effects mentioned above.

It is known that the rate of development of silver halide emulsions can be increased not only by reducing the size of the grains in the emulsion, but also by using silver chlorobromide which is essentially free of silver iodide and which, moreover, has a high silver chloride content. However, in most cases it is difficult to obtain a high speed with silver chlorobromide which is essentially free of silver iodide and which has a high silver chloride content. Hence, the raising of the emulsion speed is also of importance from the point of view of increasing the rate of development.

As mentioned earlier, there is a great need for providing silver halide photographic materials with an effective increase in speed without adversely affecting their high speed development properties. Furthermore, it is anticipated that while achieving higher speeds, the materials will also have excellent stability in processing and resistance to pressure in handling.

A method of forming emulsion grains by the socalled halogen conversion method has been disclosed in Japanese Patent Publication No. 36978/75 corresponding to U.S. Pat. No. 3,622,318 as an example of a method for obtaining high speed silver halide emulsions. However, although emulsions prepared using this method exhibit increased speed, it has been found that the speed is markedly reduced when pressure is applied to the photosensitive material. It has been discovered that this can be minimized by reducing the amount of halogen conversion, but in this case, fogging is liable to occur when pressure is applied to the photosensitive material and the gradation obtained is softer.

Furthermore, a number of techniques concerning the so-called laminated type emulsion in which the silver halide grains have layers of different halogen composition within them have been reported as methods of providing both superior development rates and high speeds.

For example, emulsions prepared by covering a silver bromide core with silver chloride or precipitating a layer of silver bromide on a core of silver chloride have been disclosed in Japanese Patent Publication No. 8939/81 corresponding to GB Patent 1,027,146 as a means of realizing the advantages of both of these materials. However, the technique disclosed therein is a wide ranging technique covering, in general, laminated type emulsions in which the grains consist of a core of silver halide which is covered with a layer of a different silver halide. According to experimental results obtained by the present inventors, it is not always possible to obtain emulsions which have the preferred performance in this way. For example, with emulsions prepared using the above mentioned technique, reversal images are liable to form in regions which have received a comparatively low level of exposure in many cases and there is a further disadvantage in that considerable desensitization occurs when pressure is applied to the emulsion. Moreover, in many cases the gradation obtained is soft and there are also cases in which the toe of the characteristic curve has a soft gradation and there are two levels of gradation.

Furthermore, a technique in which a laminated type silver chloroiodobromide emulsion which has a silver bromide content of at least 50 mol% in the outermost layer is chemically sensitized with an unstable sulfur compound in the presence of fine silver chloride grains has been disclosed in Japanese Patent Application (OPI) No. 9137/83. However, when attempts were made to prepare laminated type emulsions using the technique disclosed therein, the gradation of the toe of the characteristic curve was liable to be softened and it was also found that the material was desensitized when pressure was applied.

Moreover, it has been reported that techniques involving laminated type structures are effective for raising the speed of silver chlorobromide emulsion which have a high silver chloride content.

For example, techniques concerned with high silver chloride emulsions which have laminated type structures have been disclosed in Japanese Patent Application (OPI) Nos. 95736/83 and 108533/83 corresponding to U.S. Pat. No. 4,564,591. According to the former, high speed emulsions which can be processed quickly can be obtained by providing a layer consisting principally of silver bromide within the grains. However, when experiments were carried out in practice, it was found that desensitization was liable to occur when pressure was applied to the emulsion grains and such materials would be difficult to use in practice. Furthermore, with the latter technique, emulsions which can be processed quickly and which have a high speed and which, moreover, have a wide latitude for chemical sensitization are obtained by providing a layer consisting essentially of silver bromide on the surface of the grains. However, when experiments were carried out it was found that here again there were disadvantages; i.e., the toe of the characteristic curve was liable to be soft and, in extreme cases, two levels of gradation were observed, and furthermore the material was liable to desensitization by pressure.

Techniques involving high silver chloride emulsions which have a laminated type structure have also been disclosed in Japanese Patent Application (OPI) Nos. 222844/85 corresponding to U.S. Pat. No. 4,590,155 and 222845/85 corresponding to U.S. Pat. No. 4,605,610. However, the disadvantages of the type described above have not been overcome by theses techniques.

SUMMARY OF THE INVENTION

It is clear from the facts outlined above that there are problems with reduced contrast and poor pressure resistance when conventional techniques for increasing speed, e.g., methods of halogen conversion and laminated type structures, are used. Hence, this invention is intended to overcome such problems and to provide silver halide emulsions which have high speed and high contrast and which, moreover, have superior pressure resisting properties. In more practical terms, the invention is intended to provide a method for the preparation of silver halide emulsions with which high speeds can be achieved without adversely affecting the high speed development properties or pressure resisting properties, and to provide silver halide photographic materials which contain these emulsions.

The aim of the invention has been achieved by means of silver halide photographic materials of which the distinguishing features are that surface latent image type mono-disperse silver chlorobromide emulsions consisting of silver chlorobromide which is essentially free of silver iodide, obtained by subjecting the surface of silver halide grains, which have a plurality of layers which have different halogen compositions within the grains, to halogen conversion, are included in at least one emulsion layer on a support.

DETAILED DESCRIPTION OF THE INVENTION

The term "halogen conversion" which is used signifies that the composition of pre-formed silver halide crystals is changed by adding a substance which contains halide ions which can form a more sparingly soluble silver salt. The halogen conversion reaction occurs when a compound providing a bromide ion or a compound providing an iodide ion such as KI, NaI, etc., is added to a pure silver chloride emulsion. The reaction in which silver chloride is converted to silver bromide which occurs when potassium bromide is added to a pure silver chloride emulsion is a typical example of halogen conversion. However, in general, reaction in which the surface silver halide is changed to a composition which is richer in silver bromide, which occur in cases where the silver halide crystal which is being subjected to halogen conversion is a mixed crystal, such as a silver chlorobromide crystal for example and bromide ions are introduced into the solution in an amount which exceeds the bromide ion concentration in the solution which is at equilibrium, are included as well. In the present invention, in view of a rapid processing, the compound providing an iodide ion is added in an amount of not more than 2 mol%, preferably not more than 0.2 mol% of the total silver halide content, and most preferably, there is no compound providing the iodide ion added at all.

The distinguishing feature of the invention is that surface latent image type emulsions which are excellent in various properties, are obtained by subjecting the surface of so-called laminated type emulsion grains which have a plurality of layers of different halogen compositions to halogen conversion.

A technique concerning emulsions prepared by adding water soluble bromides and/or iodides to a laminated type emulsion has been disclosed in Japanese Patent Application (OPI) No. 39848/87. However, the above mentioned technique concerns internal latent image type direct positive emulsions and, moreover, even though the grains are of the laminated type, the difference in the halogen composition in the core and shell function is not its essential problem and it is quite different in detail from the technique of this present invention.

In this present invention, the term essentially free of silver iodide signifies that the silver iodide content is not more than 2 mol% of the total silver halide content. The silver iodide content is preferably not more than 0.2 mol% and, most desirably, there is no silver iodide present at all.

In this present invention it is an essential requirement that the grains at the stage prior to the execution of halogen conversion have a so-called laminated type structure with a plurality of layers which have different halogen compositions within the grain. In a useful laminated type structure, the proportion of the layer which is closest to the surface from among the plurality of layers which have different halogen compositions within the grain at the stage before the surface is subjected to halogen conversion is preferably at least 1 mol% but not more than 99 mol%, and most desirably at least 10 mol% but not more than 90 mol%, of the whole grain. Furthermore, the difference in the proportions of silver bromide contained in the layer closest to the surface and the layer immediately inside this layer is preferably at least 5 mol% and not more that 40 mol%, and most desirably at least 12 mol% and not more than 30 mol%. If it is less than 5 mol% it is difficult to realize the effect of the invention, and if it is in excess of 40 mol% the desensitization due to pressure described earlier becomes pronounced and this is undesirable.

Moreover, the proportion of silver bromide contained in the layer closest to the surface of the grains at the stage before subjecting the surface to halogen conversion is preferably lower than the proportion of silver bromide contained in the layer immediately on its inside.

In this present invention, the average grain size before halogen conversion is preferably not more than 2 μm and at least 0.1 μm, and most desirably it is not more than 1 μm and at least 0.15 μm. (Here the size of a grain is taken as the diameter of the grain in the case of a spherical grain or a grain which is almost spherical and as the edge length in the case of a cubic grain, the value being represented by the average based upon the projected areas.) The use of a so-called mono-disperse silver halide emulsion is preferred in this invention. The extent of the mono-dispersion is preferably such that the variation factor (the value obtained by dividing the standard deviation of the particle size distribution curve of the silver halide grains by the average particle size) is not more than 0.15 and most desirably not more than 0.10. Adverse effects such as the occurrence of differences in the extent of halogen conversion between grains during halogen conversion arise in cases where the grain size distribution is wide.

The required amount of bromide ion is then simply added in the form of a water soluble bromide in order to subject the surface of the grains of this type to halogen conversion. However, donors, with which the amount of bromine ion supplied and the rate of supply can be controlled can also be used. Organic bromides, inorganic bromides which have the appropriate solubility in water, and bromide which have been covered with encapsulating membranes or semipermeable membranes etc. can be used for this purpose. Moreover, fine grained silver halides which have a silver bromide content higher than that of the grain surface before carrying out halogen conversion can also be used.

In this present invention, the extent of halogen conversion is preferably at least 0.5 mol% and not more than 20 mol% with respect to the total silver halide, and most desirably it is at least 1 mol% and not more than 15 mol% with respect to the total silver halide. It is difficult to realize the effect of the invention if the extent of halogen conversion is less than 0.5 mol%. Further, desensitization by pressure, as described earlier becomes pronounced if the extent of halogen conversion exceeds 20 mol%.

In this present invention, the composition of the silver halide grains obtained after halogen conversion is preferably such that the silver bromide content is at least 20 mol%. A silver bromide content of at least 40 mol% is more desirable and a silver bromide content in excess of 50 mol% is especially desirable.

The silver halide emulsions of this invention can generally be prepared by the well known means. Such as a process in which silver halide grains are formed by reacting a water soluble halide with a water soluble silver salt, a de-salting process, and a chemical ripening process. The halogen conversion in this invention is preferably carried out prior to the chemical ripening process among the above mentioned processes and, moreover, it is preferably carried out prior to the desalting process and, most desirably, it is carried out as a continuation of grain formation.

The execution of the usual form of chemical sensitization during the chemical ripening process mentioned above is effective for enhancing the effect of the invention. Chemical sensitization can be achieved using the methods of sulfur sensitization, reductive sensitization or precious metal sensitization either individually or in combination.

Compounds which contain sulfur which can react with silver halides, for example thiosulfate, thioureas, mercapto compounds, rhodanines etc. can be used for sulfur sensitization purposes. details of the method of sulfur sensitization have been described in U.S. Pat. Nos. 2,410,689 and 3,501,313, West German Patent 1,422,869 and Japanese Patent Publication No. 20533/74 etc.

Stannous salts, amines, hydrazine derivatives, formamidinesulfinic acid or silane compounds etc. can be used as reducing substances in the reductive sensitization method.

Complex salts of metals of group VIII of the periodic table, such as platinum, iridium, palladium etc., can be used as well as gold complex salts for the precious metal compounds used in the precious metal sensitization method.

The reductive sensitization method and the precious metal sensitization method have been described in U.S. Pat. Nos. 2,399,083, 2,597,856, 2,597,915, 2,487,850, 2,518,698 etc.

The effect obtained by means of the invention is to provide far better performance than that of emulsions prepared using the conventional halogen conversion method or simple laminated type emulsions, and this effect could not have been predicted at all on the basis of the techniques which have been disclosed in the past.

When photosensitive materials are being prepared using emulsions of this invention, two or more monodisperse silver halide emulsions of different grain sizes can be mixed together in the same layer or coated in separate layers as a laminate to form an emulsion layer which has essentially the same color sensitivity throughout in order to satisfy the gradation requirements of the photosensitive material. Moreover, combinations of two or more types of poly-disperse silver halide emulsions or a mono-disperse emulsion and a poly-disperse emulsion can be used in the form of a mixture or laminate.

The silver halide grains which are used in the invention preferably have a regular crystalline form, such as a cubic, octahedral, dodecahedral or tetradecahedral form, though they may have an irregular crystalline form, such as a spherical form, or they may have a complex form consisting of these crystalline forms.

The photographic emulsions used in the invention can be prepared using methods such as those described by P. Glafkides in "Chemie et Physique Photographique", published by Paul Montel, 1967, by G. F. Duffin in "Photographic Emulsion Chemistry", published by Focal Press, 1966, or by V. L. Zelikman et al. in "Making and Coating Photographic Emulsions", published by Focal Press, 1964, etc. That is to say, they can be prepared using acidic methods, neutral methods and ammonia methods etc., and the one-sided mixing method, the simultaneous mixing method or combinations of these methods can be used for reacting the soluble silver salt with the soluble halogen salt.

Methods in which the grains are formed in the presence of an excess of silver ion (the so-called inverse mixing method) can also be used. The method in which the pAg of the liquid phase in which the silver halide is being formed is held constant, which is to say the so-called controlled double jet method, can be used as one embodiment of a simultaneous mixing method. When this method is used, the crystal form is regular and silver halide emulsions in which the grains are almost uniform are obtained.

Additives which can be used during the manufacture of silver halide emulsions in accordance with the invention are described below.

For example ammonia, potassium thiocyanate, ammonium thiocyanate, thioether compounds (for example those disclosed in U.S. Pat. Nos. 3,271,157, 3,574,628, 3,704,130, 4,297,439, 4,276,374 etc.), thione compounds (for example those disclosed in Japanese Patent Application (OPI) Nos. 144319/78, 82408/78, 77737/80 etc.), amine compounds (for example those disclosed in Japanese Patent Application (OPI) No. 100717/79 etc.) etc. can be used as silver halide solvents for controlling grain growth during the formation of the silver halide grains in accordance with the invention.

Cadmium salts, zinc salts, thallium salts, iridium salts or complex salts thereof, rhodium salts or complex salts thereof and iron salts or complex salts thereof etc. may also be present during the formation or physical ripening of the silver halide grains.

Various compounds can also be included in the photographic emulsions of this invention with a view to preventing the occurrence of fogging during the manufacture, storage or photographic processing of the photosensitive material or stabilizing photographic performance. Thus, many compounds which are known as antifoggants or stabilizers, such as azoles, for example benzothiazolium salts, nitroindazoles, benzimidazoles (especially those substituted with nitro groups or halogen atoms); heterocyclic mercapto compounds, for example mercaptothiazoles, mercaptobenzothiazoles, mercaptobenzimidazles, mercaptothiadiazoles, mercaptotetrazoles (especially 1-phenyl-5-mercaptotetrazole), mercaptopyrimidines; the above mentioned heterocyclic mercapto compounds which have water solubilizing groups such as carboxyl groups or sulfone groups; thioketones, for example oxazolinthione; azaindenes, for example tetraazaindenes (especially the 4-hydroxy substituted (1,3,3a,7)tetra-azaindenes); and benzenethiosulfonic acids, benzenesulfinic acids; etc. may be added.

Color couplers, such as cyan couplers, magenta couplers and yellow couplers, and compounds which diffuse couplers, can be included in the silver halide photographic emulsions of this invention.

Thus, compounds which can form a color by oxidative coupling with a primary aromatic amine developing agent (for example a phenylenediamine derivative or an aminophenol derivative etc.) in a color development process can be included. For example, there are the 5-pyrazolone couplers and pyrazoloazole couplers etc. as magenta couplers, the acylacetamide couplers (for example the benzoylacetanilides and pivaloylacetanilides) etc. as yellow couplers and the naphthol and phenol couplers as cyan couplers. These couplers are preferably fast to diffusion, having a so-called hydrophobic group as a ballast group within the molecule. These couplers may be of the four equivalent type or the two equivalent type with respect to silver ion. They may also be colored couplers which have a color correcting effect or couplers which release a development inhibitor as development proceeds (so-called DIR couplers).

Colorless DIR coupling compounds of which the products of the coupling reaction are colorless and which release a development inhibitor may also be included as well as the DIR couplers.

Photographic emulsions of this invention may also contain polyalkylene oxide or ether, ester or amine etc, derivatives thereof, thioether compounds, thiomorpholines, quaternary ammonium salts, urethane derivatives, urea derivatives, imidazole derivatives, 3-pyrazolidones etc., for example, with a view to increasing speed, increasing contrast or accelerating development.

The well known water soluble dyes (for example oxonol dyes, hemioxonol dyes and merocyanine dyes) may be used as filter dyes, for preventing irradiation, and for various other purposes in the silver halide photographic emulsions of this invention. Furthermore, the well known cyanine dyes, merocyanine dyes and hemicyanine dyes etc. may be used before, during or after chemical sensitization as spectral sensitizers or for controlling the form and size of the silver halide.

A variety of surfactants may be included in the photographic emulsions of this invention as coating promoters, anti-static agents, for improving slip properties, for emulsification and dispersion purposes, for the prevention of sticking and for improving photographic characteristics (for example for accelerating development, increasing contrast, speed) etc.

Furthermore, concrete disclosures are made in *Research Disclosure* Vol. 176 (December 1978) No. RD-17643 etc. in connection with anti-color fading agents, film hardening agents, anti-color fogging agents, ultraviolet absorbers, protective colloids such as gelatin, and various other additives for the photosensitive materials of this invention.

The finished emulsion can be coated onto a suitable support, for example baryta paper, resin coated paper, synthetic paper, triacetate film, polyethyleneterephthalate film, other plastic bases or glass plates.

The silver halide photographic materials of this invention can be used for example as color positive films, color papers, color negative films, color reversal films (including those which include couplers and those which do not), photographic materials for plate making purposes (for example, lith films, lith duplicating films, etc. ), photosensitive materials for cathode ray tube display purposes, photosensitive materials for X-ray recording purposes, photosensitive materials for. silver salt diffusion transfer process purposes, photosensitive materials for color diffusion transfer process purposes, photosensitive materials for dye transfer (inhibition transfer), process purposes, emulsions in which the silver dye bleach method is used, photosensitive materials for recording print-out images, direct print image photosensitive materials, heat developable photosensitive materials and photosensitive materials for physical development purposes etc.

The exposure for obtaining a photographic image can be made using the normal methods. That is to say, a variety of known light sources such as incandescent light (daylight), tungsten lamps, fluorescent lamps, mercury lamps, xenon arc lamps, carbon arc lamps, xenon flash lamps and the flying spot of a cathode tube etc. can be used for this purposes. The exposure time may of course be from one thousandth of a second to one second as used in a normal camera, or it may be shorter than one thousandth of a second, for example from one ten thousandth of a second to one millionth of a second, in cases where a xenon strobe light or a cathodes ray tube is used, or it may be longer than one second. The spectral composition of the light used for the exposure can be adjusted, as required, using color filters. Laser light can also be used for making the exposure. Moreover, exposures can also be made using the light emitted from phosphors which have been excited by an electron beam, X-rays, γ-rays, α-rays etc.

All of the known methods and known processing baths, such as those disclosed in *Research Disclosure* No. 176, pages 28 to 30 (RD-17643) for example, can be used for the photographic processing of the photosensitive materials of this invention. This photographic processing may take the form of photographic processing in which a silver image is formed (black and white photographic processing) or photographic processing in which a dye image is formed (color photographic processing) as required. A processing temperature between 18° C. and 50° C. is normally selected but temperatures below 18° C. and in excess of 50° C. can be used.

The following examples are provided for illustrative perposes only and are in no way intended to limit the scope of the present invention.

EXAMPLE 1

Lime treated gelatin (32 grams) was added to 1000 ml of distilled water and dissolved at 40° C., after which 5.5 grams of sodium chloride was added and the temperature was raised to 65° C. N,N'-dimethylimidazolidin-2-thione (2.6 ml, 1% aqueous solution) was added to this solution. Next, a solution obtained by dissolving 80.0 grams of silver nitrate in 400 ml of distilled water and a solution obtained by dissolving 39.2 grams of potassium bromide and 8.3 grams of sodium chloride in 400 ml of distilled water were added to and mixed with the aforementioned solution over a period of 26 minutes while maintaining the temperature at 65° C. Moreover, a solution obtained by dissolving 80.0 grams of silver nitrate in 400 ml of distilled water and a solution obtained by dissolving 39.2 grams of potassium bromide and 8.3 grams of sodium chloride in 400 ml of distilled water were added to and mixed with the solution over a further period of 20 minutes while maintaining the temperature at 65° C. The silver chlorobromide emulsion (silver bromide content 70 mol%) so obtained was desalted and washed with water and then 4.5 mg of sodium thiosulfate was added and the emulsion was chemically sensitized optimally at 60° C. This was emulsion A.

An emulsion was prepared in just the same way as emulsion A except that the aqueous alkali halide solution added on the second occasion was changed to a solution obtained by dissolving 43.2 grams of potassium bromide and 9.1 grams of sodium chloride in 440 ml of distilled water, the addition being started at the same time as the second aqueous silver nitrate solution. Moreover, in this case the aqueous silver nitrate solution was added over a period of 20 minutes while the aqueous alkali halide solution was added over a period of 22 minutes. This was emulsion B.

An emulsion was prepared in just the same way as emulsion A except that the aqueous alkali halide solution added on the second occasion was changed to a solution obtained by dissolving 66.7 grams of potassium bromide and 14.1 grams of sodium chloride in 680 ml of distilled water, the addition being started at the same time as the second aqueous silver nitrate solution. Moreover, in this case the aqueous silver nitrate solution was added over a period of 20 minutes while the aqueous alkali halide solution was added over a period of 34 minutes. This was emulsion C.

Next, lime treated gelatin (32 grams) was added to 1000 ml of distilled water and dissolved at 40° C., after which 5.8 grams of sodium chloride was added and the temperature was raised to 65° C. N,N'-dimethylimidazolidin-2(2.6 ml, 1% aqueous solution) was added to this solution. Then, a solution obtained by dissolving 80.0 grams of silver nitrate in 400 ml of distilled water and a solution obtained by dissolving 40.4 grams of potassium bromide and 7.7 grams of sodium chloride in 400 ml of distilled water were added to and mixed with the aforementioned solution over a period of 26 minutes while maintaining the temperature at 65° C. Moreover, a solution obtained by dissolving 80.0 grams of silver nitrate in 400 ml of distilled water and a solution obtained by dissolving 38.1 grams of potassium bromide and 8.8 grams of sodium chloride in 400 ml of distilled water were added to and mixed with the solution over a further period of 20 minutes while maintaining the temperature at 65° C. The silver chlorobromide emulsion (silver bromide content 70 mol%: here the silver bromide content of the core was 72 mol% and the silver bromide content of the shell was 68 mol%) so obtained was de-salted and washed with water and then 4.5 mg of sodium thiosulfate was added and the emulsion was chemically sensitized optimally at 60° C. This was emulsion D.

An emulsion was prepared in just the same way as emulsion D except that the aqueous alkali halide solution added on the second occasion was changed to a solution obtained by dissolving 42.0 grams of potassium bromide and 9.1 grams of sodium chloride in 440 ml of distilled water, the addition being started at the same time as the second aqueous silver nitrate solution. Moreover, in this case the aqueous silver nitrate solution was added over a period of 20 minutes while the aqueous alkali halide solution was added over a period of 22 minutes. This was emulsion E.

An emulsion was prepared in just the same way as emulsion D except that the aqueous alkali halide solution added on the second occasion was changed to a solution obtained by dissolving 65.6 grams of potassium bromide and 15.2 grams of sodium chloride in 690 ml of distilled water, the addition being started at the same time as the second aqueous silver nitrate solution. Moreover, in this case the aqueous silver nitrate solution was added over a period of 20 minutes while the aqueous alkali halide solution was added over a period of 34 minutes 30 seconds. This was emulsion F.

Next, lime treated gelatin (32 grams) was added to 1000 ml of distilled water and dissolved at 40° C., after which 5.5 grams of sodium chloride was added and the temperature was raised to 65° C. N,N'-dimethylimidazolidin-2-thione (2.6 ml, 1% aqueous solution) was added to this solution. Then, a solution obtained by dissolving 80.0 grams of silver nitrate in 400 ml of distilled water and a solution obtained by dissolving 44.8 grams of potassium bromide and 5.5 grams of sodium chloride in 400 ml of distilled water were added to and mixed with the aforementioned solution over a period of 28 minutes while maintaining the temperature at 65° C. Moreover, a solution obtained by dissolving 80.0 grams of silver nitrate in 400 ml of distilled water and a solution obtained by dissolving 33.6 grams of potassium bromide and 11.0 grams of sodium chloride in 400 ml of distilled water were added to and mixed with the solution over a further period of 20 minutes while maintaining the temperature at 65° C. The silver chlorobromide emulsion (silver bromide content 70 mol%: here the silver bromide content of the core was 80 mol% and the silver bromide content of the shell was 60 mol%) so obtained was de-salted and washed with water and then 4.5 mg of sodium thiosulfate was added and the emulsion was chemically sensitized optimally at 60° C. This was emulsion G.

An emulsion was prepared in just the same way as emulsion G except that the aqueous alkali halide solution added on the second occasion was changed to a solution obtained by dissolving 37.6 grams of potassium bromide and 12.3 grams of sodium chloride in 447 ml of distilled water, the addition being started at the same time as the second aqueous silver nitrate solution. Moreover, in this case the aqueous silver nitrate solution was added over a period of 20 minutes while the aqueous alkali halide solution was added over a period of 22 minutes 20 seconds. This was emulsion H.

An emulsion was prepared in just the same way as emulsion G except that the aqueous alkali halide solution added on the second occasion was changed to a solution obtained by dissolving 61.1 grams of potassium bromide and 20.0 grams of sodium chloride in 727 ml of distilled water, the addition being started at the same time as the second aqueous silver nitrate solution. Moreover, in this case the aqueous silver nitrate solution was added over a period of 20 minutes while the aqueous alkali halide solution was added over a period of 36 minutes 20 seconds. This was emulsion I.

Next, lime treated gelatin (32 grams) was added to 1000 ml of distilled water and dissolved at 40° C., after which 5.5 grams of sodium chloride was added and the temperature was raised to 65° C. N,N'-dimethylimidazolidin-2-thione (2.6 ml, 1% aqueous solution) was added to this solution. Then, a solution obtained by dissolving 80.0 grams of silver nitrate in 400 ml of distilled water and a solution obtained by dissolving 33.6 grams of potassium bromide and 11.0 grams of sodium chloride in 400 ml of distilled water were added to and mixed with the aforementioned solution over a period of 24 minutes while maintaining the temperature at 65° C. Moreover, a solution obtained by dissolving 80.0 grams of silver nitrate in 400 ml of distilled water and a solution obtained by dissolving 44.8 grams of potassium bromide and 5.5 grams of sodium chloride in 400 ml of distilled water were added to and mixed with the solution over a further period of 20 minutes while maintaining the temperature at 65° C. The silver chlorobromide emulsion (silver bromide content 70 mol%: here the silver bromide content of the core was 60 mol% and the silver bromide content of the shell was 80 mol%) so obtained was de-salted and washed with water and then 4.5 mg of sodium thiosulfate was added and the emulsion was chemically sensitized optimally at 60° C. This was emulsion J.

An emulsion was prepared in just the same way as emulsion J except that the aqueous alkali halide solution added on the second occasion was changed to a solution obtained by dissolving 48.8 grams of potassium bromide and 6.0 grams of sodium chloride in 435 ml of distilled water, the addition being started at the same time as the second aqueous silver nitrate solution. Moreover, in this case the aqueous silver nitrate solution was added over a period of 20 minutes while the aqueous alkali halide solution was added over a period of 21 minutes 45 seconds. This was emulsion K.

An emulsion was prepared in just the same way as emulsion J except that the aqueous alkali halide solution added on the second occasion was changed to a solution obtained by dissolving 72.3 grams of potassium bromide and 8.9 grams of sodium chloride in 645 ml of distilled water, the addition being started at the same time as the second aqueous silver nitrate solution. Moreover, in this case the aqueous silver nitrate solution was added over a period of 20 minutes while the aqueous alkali halide solution was added over a period of 32 minutes 15 seconds. This was emulsion L.

Next, lime treated gelatin (32 grams) was added to 1000 ml of distilled water and dissolved at 40° C., after which 5.5 grams of sodium chloride was added and the temperature was raised to 65° C. N,N'-dimethylimidazolidin-2-thione (2.6 ml, 1% aqueous solution) was added to this solution. Then, a solution obtained by dissolving 80.0 grams of silver nitrate in 400 ml of distilled water and a solution obtained by dissolving 51.6 grams of potassium bromide and 2.2 grams of sodium chloride in 400 ml of distilled water were added to and mixed with the aforementioned solution over a period of 30 minutes while maintaining the temperature at 65° C. Moreover, a solution obtained by dissolving 80.0 grams of silver nitrate in 400 ml of distilled water and a solution obtained by dissolving 26.9 grams of potassium bromide and 14.3 grams of sodium chloride in 400 ml of distilled water were added to and mixed with the solution over a further period of 20 minutes while maintaining the temperature at 65° C. The silver chlorobromide emulsion (silver bromide content 70 mol%: here the silver bromide content of the core was 92 mol% and the silver bromide content of the shell was 48 mol%) so obtained was de-salted and washed with water and then 4.5 mg of sodium thiosulfate was added and the emulsion was chemically sensitized optimally at 60° C. This was emulsion M.

A emulsion was prepared in just the same way as emulsion M except that the aqueous alkali halide solution added on the second occasion was changed to a solution obtained by dissolving 30.8 grams of potassium bromide and 16.4 grams of sodium chloride in 458 ml of distilled water, the addition being started at the same time as the second aqueous silver nitrate solution. Moreover, in this case the aqueous silver nitrate solution was added over a period of 20 minutes while the aqueous alkali halide solution was added over a period of 22 minutes 55 seconds. This was emulsion N.

An emulsion was prepared in just the same way as emulsion M except that the aqueous alkali halide solution added on the second occasion was changed to a solution obtained by dissolving 54.4 grams of potassium bromide and 28.9 grams of sodium chloride in 808 ml of distilled water, the addition being started at the same time as the second aqueous silver nitrate solution. Moreover, in this case the aqueous silver nitrate solution was added over a period of 20 minutes while the aqueous alkali halide solution was added over a period of 40 minutes 25 seconds. This was emulsion 0.

The grain sizes, grain size distributions and the forms of the grains of the emulsions A to 0 obtained in this way are summarized in Table 1 below.

The fifteen emulsion types A to 0 were coated onto cellulose triacetate bases in such a way that the coated silver weight was 3.5 g/m$^2$ and the coated gelatin weight was 5 g/m$^2$. The samples were exposed through a continuous wedge for 1 second using a white light of color temperature 5400° K and then they were developed and processed in the manner indicated below. Then, the photographic densities were measured with a densitometer. The results are shown in Table 2 below obtained.

| Process | Temperature | Time |
|---|---|---|
| Development | 20° C. | 10 minutes |
| Fixing | 20° C. | 3 minutes |
| Water washing | 20° C. | 5 minutes |
| Development Bath | | |
| Ascorbic acid | | 10 grams |
| p-Methylaminophenol | | 2.4 grams |
| Sodium carbonate | | 1 grams |
| Potassium bromide | | 1 gram |
| Water | to make up to 1 liter | |
| Fixing Bath | | |
| Sodium thiosulfate | | 300 grams |
| Anhydrous sodium sulfite | | 15 grams |
| Glacial acetic acid | | 12 grams |
| Water | to make up to 1 liter | |

TABLE 1

| Emulsion | Ave. Grain Size* (μ) | Grain Size Distribution (Var. Coeff.)** | Form of the Grains |
|---|---|---|---|
| A | 0.51 | 0.10 | Cubic |
| B | 0.51 | 0.12 | Slightly irregular cubic |
| C | 0.51 | 0.16 | Irregular cubic |
| D | 0.50 | 0.10 | Cubic |
| E | 0.50 | 0.10 | Slightly rounded cubic |
| F | 0.50 | 0.12 | Rounded cubic |
| G | 0.52 | 0.11 | Cubic |
| H | 0.52 | 0.11 | Slightly rounded cubic |
| I | 0.52 | 0.12 | Rounded cubic |
| J | 0.51 | 0.11 | Somewhat irregular cubic |
| K | 0.51 | 0.11 | Somewhat irregular cubic |
| L | 0.51 | 0.12 | Slightly irregular cubic |
| M | 0.50 | 0.12 | Somewhat irregular Cubic |
| N | 0.50 | 0.12 | Somewhat irregular cubic |
| O | 0.50 | 0.13 | Slightly irregular cubic |

*The average grain size is the number average of the diameter of the circles of the same areas as the projected areas of the grains.
*The variation coefficient is the value obtained by dividing the standard deviation of the grain size distribution by the average grain size.

TABLE 2

| Emulsion | Result: Speed* | Toe Gradation | Pressure Desensitization | Remarks |
|---|---|---|---|---|
| A | 100 | 0.31 | 95 | Comparative Example |
| B | 191 | 0.50 | 81 | Comparative Example |
| C | 274 | 0.67 | 23 | Comparative Example |
| D | 117 | 0.42 | 91 | Comparative Example |
| E | 296 | 0.34 | 94 | This Invention |
| F | 313 | 0.37 | 87 | This Invention |
| G | 271 | 0.51 | 63 | Comparative Example |
| H | 334 | 0.31 | 94 | This Invention |
| I | 352 | 0.34 | 89 | This Invention |
| J | 293 | 0.56 | 47 | Comparative Example |
| K | 339 | 0.35 | 91 | This Invention |
| L | 358 | 0.38 | 83 | This Invention |
| M | 310 | 0.61 | 29 | Comparative Example |
| N | 349 | 0.37 | 87 | This Invention |

TABLE 2-continued

| Emulsion | Result: Speed* | Toe Gradation | Pressure Desensitization | Remarks |
|---|---|---|---|---|
| O | 361 | 0.40 | 76 | This Invention |

*The speed is indicated as a relative value where the speed of the sample in which emulsion A had been used was taken as being 100.

In Table 2 above, the speed is represented by the reciprocal of the exposure amount which provided an optical density 0.4 higher than the fog density and it is shown in Table 2 as a relative value taking the speed of emulsion A as 100. Furthermore, the toe gradation is represented by the difference between the logarithm of the exposure amount which provided an optical density 0.4 higher than the fog density and the logarithm of the exposure which provided an optical density 0.04 higher than the fog density. Pressure desensitization is the density observed at an exposure amount corresponding to the exposure amount with which the speed of the sample was obtained on exposure and development after the coated sample had been flexed through 90° C., and it is expressed as a relative value taking a density of 0.4 as 100.

It is clear from the above results that although there is an increase in speed due to halogen conversion with emulsions A to C., this is accompanied by a softening of toe gradation and a worsening of desensitization due to pressure since these emulsions do not have a laminated structure. Furthermore, with emulsions such as D, G, J and M which simply have a laminated structure, there is some increase in speed, but this is accompanied by a softening of the toe gradation and a worsening of desensitization by pressure. When halogen conversion is carried out after forming a laminated structure, as in the case of this invention, excellent emulsions which had a high speed, of which the toe gradation had a high contrast and which exhibited little desensitization due to pressure were obtained.

EXAMPLE 2

Lime treated gelatin (32 grams) was added to 1280 ml of distilled water and dissolved at 40° C., after which 11.3 grams of sodium chloride was added and the temperature was raised to 70° C. N,N'-dimethylimidazolidin-2-thione (3.8 ml, 1% aqueous solution) was added to this solution. Next, a solution obtained by dissolving 32.0 grams of silver nitrate in 180 ml of distilled water and a solution obtained by dissolving 17.7 grams of potassium bromide and 2.3 grams of sodium chloride in 180 ml of distilled water were added to and mixed with the aforementioned solution over a period of 40 minutes while maintaining the temperature at 70° C. Moreover, a solution obtained by dissolving 128.0 grams of silver nitrate in 360 ml of distilled water and a solution obtained dissolving 70.8 grams of potassium bromide and 9.2 grams of sodium chloride in 360 ml of distilled water were added to and mixed with the solution over a further period of 24 minutes while maintaining the temperature at 70° C. The silver chlorobromide emulsion (silver bromide content 79 mol%) so obtained was desalted and washed with water and then 2.5 mg of sodium thiosulfate was added and the emulsion was chemically sensitized optimally at 60° C. This was emulsion P.

An emulsion was prepared in just the same way as emulsion P except that the aqueous alkali halide solution added on the second occasion was changed to a solution obtained by dissolving 74.8 grams of potassium bromide and 9.8 grams of sodium chloride in 380 ml of distilled water, the addition being started at the same time as the second aqueous silver nitrate solution. Moreover, in this case the aqueous silver nitrate solution was added over a period of 24 minutes while the aqueous alkali halide solution was added over a period of 25 minutes 20 seconds. This was emulsion Q.

Next, lime treated gelatin (32 grams) was added to 1280 ml of distilled water and dissolved at 40° C., after which 11.3 grams of sodium chloride was added and the temperature was raised to 74° C. N,N'-dimethylimidazolidin-2-thione (3.8 ml, 1% aqueous solution) was added to this solution. Then, a solution obtained by dissolving 32.0 grams of silver nitrate in 180 ml of distilled water and a solution obtained by dissolving 21.3 grams of potassium bromide and 0.6 grams of sodium chloride in 180 ml of distilled water were added to and mixed with the aforementioned solution over a period of 20 minutes while maintaining the temperature at 74° C. Moreover, a solution obtained by dissolving 128.0 grams of silver nitrate in 360 ml of distilled water and a solution obtained by dissolving 67.3 grams of potassium bromide and 11.0 grams of sodium chloride in 360 ml of distilled water were added to and mixed with the solution over a further period of 24 minutes while maintaining the temperature at 74° C. The silver chlorobromide emulsion (silver bromide content 79 mol%: here the silver bromide content of the core was 95 mol% and the silver bromide content of the shell was 75 mol%) so obtained was de-salted and washed with water and then 2.5 mg of sodium thiosulfate was added and the emulsion was chemically sensitized optimally at 60° C. This was emulsion R.

An emulsion was prepared in just the same way as emulsion R except that the aqueous alkali halide solution added on the second occasion was changed to a solution obtained by dissolving 71.2 grams of potassium bromide and 11.7 grams of sodium chloride in 381 ml of distilled water, the addition being started at the same time as the second aqueous silver nitrate solution. Moreover, in this case the aqueous silver nitrate solution was added over a period of 24 minutes while the aqueous alkali halide solution was added over a period of 25 minutes 24 seconds. This was emulsion S.

The grain sizes, grain size distributions and the forms of the grains in emulsions P to S obtained in this way are summarized in Table 3 below.

TABLE 3

| Emulsion | Ave. Grain Size (μ)* | Grain Size Distribution (Var. Coeff.)** | Form of the Grains |
|---|---|---|---|
| P | 0.83 | 0.08 | Cubic |
| Q | 0.83 | 0.09 | Slightly rounded cubic |
| R | 0.82 | 0.09 | Slightly rounded cubic |
| S | 0.82 | 0.10 | Slightly rounded Cubic |

*The average grain size is the number average of the diameters of the circles of the same areas as the projected areas of the grains.
**The variation coefficient is the value obtained by dividing the standard deviation of the grain size distribution by the average grain size.

Coating liquids were prepared in the way outlined below using these emulsions P to S and the emulsions A, B, G and H which were used in Example 1. The coating liquids were then coated onto a paper support which had been laminated with polyethylene on both sides. Multilayer color printing papers with the layer structure indicated in Table 4 below were obtained and these were used to test the effect of the invention. The emulsions used in each sample were as shown in Table 5 below.

Preparation of the First Layer Coating Liquid 7 Ethyl acetate (27.2 ml) and 7.9 ml of solvent (c) were added to 19.1 grams of yellow coupler (a) and 4.4 grams of colored image stabilizer (b) and the solution obtained was emulsified and dispersed in 185 ml of a 10% aqueous gelatin solution which contained 8 ml of 10% sodium dodecylbenzenesulfonate.

On the other hand, an emulsion was prepared by adding the blue sensitive sensitizing dye indicated below at a rate of $5.0\times10^{-4}$ mol per mol of silver to the silver chlorobromide emulsion (1.0 mol% silver bromide, containing 70 g/kg of silver). This emulsion and the aforementioned emulsified dispersion were mixed together to form a solution and the first layer coating liquid which had the composition shown in Table 4 below was obtained. The coating liquids for the second to the seventh layers were prepared using the same method as for the first layer coating liquid. Moreover, 1-oxy-3,5-dichloro-s-triazine sodium salt was used in an amount of 0.015 g per gram of gelatin as a gelatin hardening agent in each layer.

The spectrally sensitizing dyes used in each layer were as indicated below.

Blue Sensitive Emulsion Layer

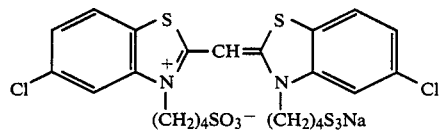

($5.0\times10^{-4}$ mol per mol of silver halide)

Green Sensitive Emulsion Layer

-continued

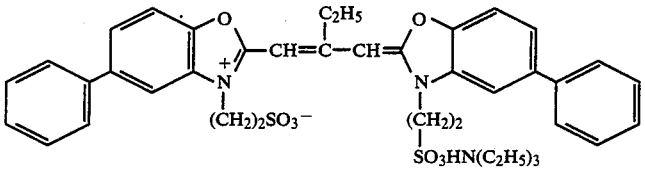

($4.0 \times 10^{-4}$ mol per mol of silver halide)

and

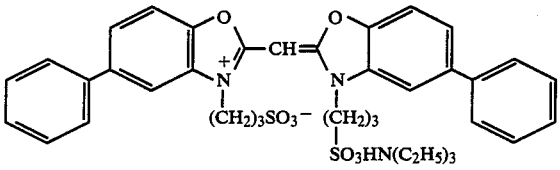

($7.0 \times 10^{-5}$ mol per mol of silver halide)

Red Sensitive Emulsion Layer

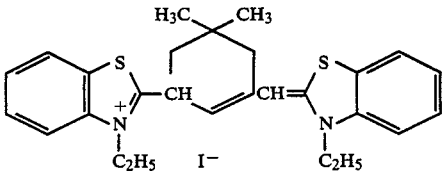

($0.9 \times 10^{-4}$ mol per mol of silver halide)

The dyes indicated below were added to the emulsion layers to prevent the occurrence of irradiation.

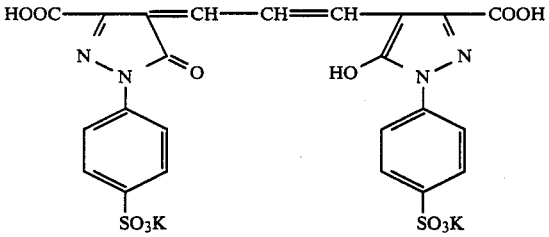

and

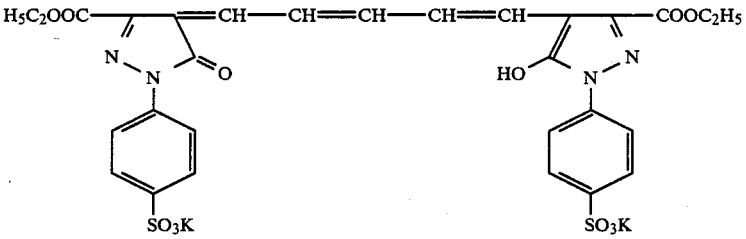

The structural formulae of the compounds used as couplers etc. in this example are shown below.

(a) Yellow Coupler

-continued
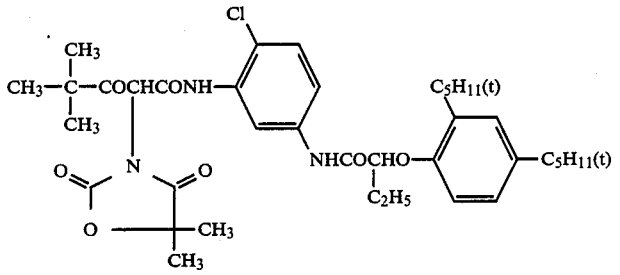
(b) Colored Image Stabilizer
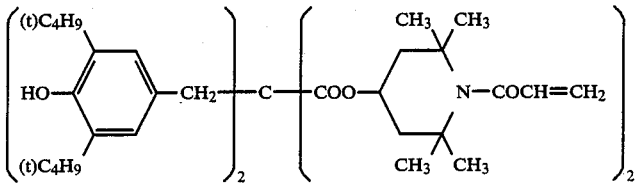
(c) Solvent
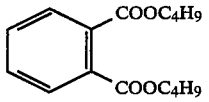
(d) Anti-Color Mixing Agnet
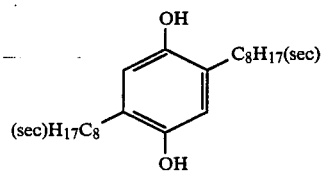
(e) Magenta Coupler
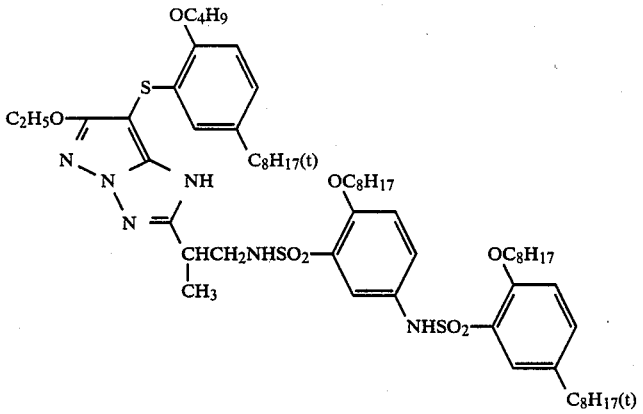
(f) Colored Image Stabilizer
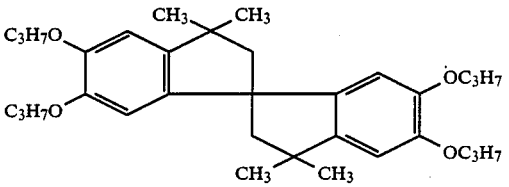
(g) Colored Image Stabilizer -continued
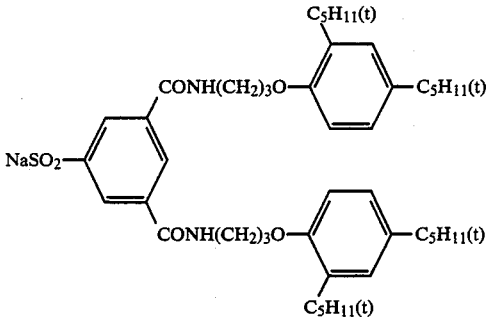
(h) Colored Image Stabilizer
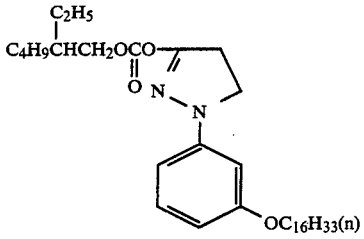
(i) Solvent: A 2:1 (by weight) mixture of
$(C_8H_{17}O)_3P{=}O$
and
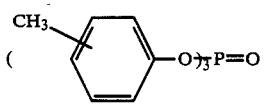
(j) Ultraviolet Absorber: a 1:5:3 (mol ratio) mixture of
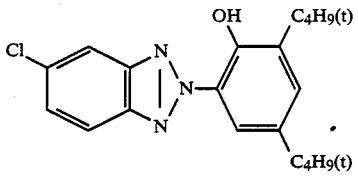
and
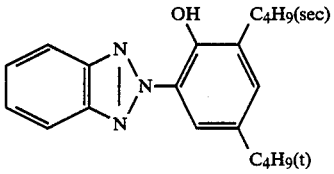
and
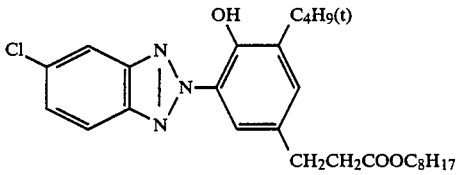
(k) Anti-Color Mixing Agent -continued

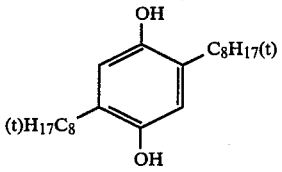

(l) Solvent $(iso C_9H_{18}O)_3P{=}O$ (m) Cyan Coupler

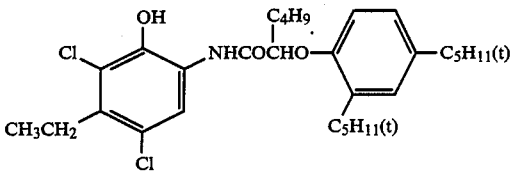

(n) Colored Image Stabilizer: a 1:3:3 (mol ratio) mixture of

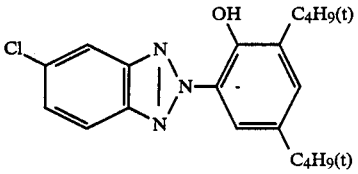

and

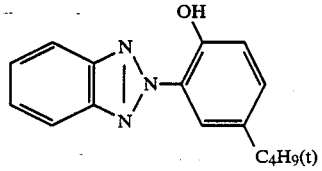

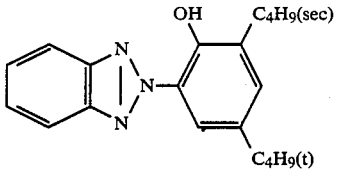

TABLE 4

| Layer | Principal Composition | Amount Used |
|---|---|---|
| Seventh Layer (Protective Layer) | Gelatin | 1.33 g/m$^2$ |
| | Acrylic modified polymer of polyvinyl alcohol (17% modification) | 0.17 g/m$^2$ |
| Sixth Layer (Ultraviolet Absorbing layer) | Gelatin | 0.54 g/m$^2$ |
| | Ultraviolet absorber (j) | 0.21 g/m$^2$ |
| | Solvent (l) | 0.09 cc/m$^2$ |
| Fifth Layer (Red Sensitive Layer) | Silver chlorobromide emulsion | 0.24 g/m$^2$ |
| | Geletin | 0.96 g/m$^2$ |
| | Cyan coupler (m) | 0.38 g/m$^2$ |
| | Colored image stabilizer (n) | 0.17 g/m$^2$ |
| | Solvent (c) | 0.23 cc/m$^2$ |
| Fourth Layer (Ultraviolet Absorbing Layer | Gelatin | 1.60 g/m$^2$ |
| | Ultraviolet absorber (j) | 0.62 g/m$^2$ |
| | Anti-color mixing agent (k) | 0.05 g/m$^2$ |
| | Solvent (l) | 0.26 cc/m$^2$ |
| Third Layer (Green Sensitive Layer) | Silver chlorobromide emulsion | 0.16 g/m$^2$ |
| | Gelatin | 1.80 g/m$^2$ |
| | Magenta coupler (e) | 0.45 g/m$^2$ |
| | Colored image stabilizer (f) | 0.20 g/m$^2$ |

TABLE 4-continued

| Layer | Principal Composition | Amount Used |
|---|---|---|
| | Colored image stabilizer (g) | 0.02 g/m$^2$ |
| | Colored image stabilizer (h) | 0.03 g/m$^2$ |
| | Solvent (i) | 0.45 cc/m$^2$ |
| Second Layer (Anti-Color Mixing Layer) | Gelatin | 0.99 g/m$^2$ |
| | Anti-color mixing agent (d) | 0.08 g/m$^2$ |
| First Layer (Blue Sensitive Layer) | Silver chlorobromide emulsion | 0.27 g/m$^2$ |
| | Gelatin | 1.86 g/m$^2$ |
| | Yellow coupler (a) | 0.74 g/m$^2$ |
| | Colored image stabilizer (b) | 0.17 g/m$^2$ |
| | Solvent (c) | 0.31 g/m$^2$ |
| Support | Polyethylene laminated paper (With white pigment ($TiO_2$) and ultramarine dye in the polyethylene on the first layer side) | |

The amount of silver chlorobromide emulsion coated is indicated as the value calculated as silver.

TABLE 5

| Sample | Sensitive Layer Blue | Green | Red | Remarks |
|---|---|---|---|---|
| a | Emulsion P | Emulsion A | Emulsion A | Comparative Example |
| b | Emulsion Q | Emulsion B | Emulsion B | Comparative Example |
| c | Emulsion R | Emulsion G | Emulsion G | Comparative Example |
| d | Emulsion S | Emulsion H | Emulsion H | This Invention |

| Process | Temperature | Time |
|---|---|---|
| Development | 33° C. | 3 min 30 sec |
| Bleach-fix | 33° C. | 1 min 30 sec |
| Water wash | 28–35° C. | 3 min |

Development Bath

| | |
|---|---|
| Nitrilotriacetic acid, tri-sodium salt | 2.0 grams |
| Benzyl alcohol | 15.0 ml |
| Diethylene glycol | 10.0 ml |
| $Na_2SO_3$ | 2.0 grams |
| KBr | 0.5 gram |
| Hydroxylamine sulfate | 3.0 grams |
| 4-Amino-3-methyl-N-ethyl-N-[β-(methanesulfonamido)ethyl]-p-phenylenediamine sulfate | 5.0 grams |
| $Na_2CO_3.H_2O$ | 30.0 grams |
| Water | to make up to 1 liter (pH 10.1) |

Bleach-Fix Bath

| | |
|---|---|
| Ammonium thiosulfate (54 wt %) | 150.0 ml |
| $Na_2SO_3$ | 15.0 grams |
| $NH_4[Fe(EDTA)]$ | 55.0 grams |
| EDTA-2Na | 4.0 grams |
| Water | to make up to 1 liter (pH 6.9) |

The results obtained on measuring the color densities of each layer are shown in Table 6 below.

TABLE 6

| Sample | Sensitive Layer | Results Speed* | Toe Gradation | Pressure Desensitization | Remarks |
|---|---|---|---|---|---|
| a | Blue | 100 | 0.33 | 94 | Comparative Ex. |
| | Green | 100 | 0.31 | 95 | Comparative Ex. |
| | Red | 100 | 0.31 | 95 | Comparative Ex. |
| b | Blue | 197 | 0.54 | 72 | Comparative Ex. |
| | Green | 191 | 0.51 | 82 | Comparative Ex. |
| | Red | 190 | 0.50 | 83 | Comparative Ex. |
| c | Blue | 271 | 0.56 | 58 | Comparative Ex. |
| | Green | 272 | 0.52 | 65 | Comparative Ex. |
| | Red | 270 | 0.51 | 66 | Comparative Ex. |
| d | Blue | 338 | 0.34 | 90 | This Invention |
| | Green | 335 | 0.32 | 94 | |
| | Red | 332 | 0.31 | 95 | |

*The speed is indicated as a relative value taking the speed of each layer of sample a to be 100.

In the Table, smaller value of toe gradation in a Sample means that the Sample is of higher contrast. Therefore, it is clear from the results obtained in the Table that Sample d had a higher sensitivity than that of Samples a to c, especially Sample d was more than 3 times higher in it's sensitivity than that of Sample a, and the toe gradation of Sample d was of higher contrast and was more excellent in resistance to pressure than those of Samples b and c.

EXAMPLE 3

Coating liquids were prepared using the emulsions used in Example 2 and using the same method as in Example 2 and Multi-layer color printing papers of which the layer structure is shown in Table 7 below were prepared by coating these coating liquids on a paper support which had been laminated on both sides with polyethylene and the effect of the invention was tested. The emulsions used in each sample are shown in Table 8 below.

The samples e to h were exposed and developed using the same procedure as in Example 2 and density measurements were made. It was clear from the results obtained that, as in Example 2, Sample h, in which emulsions of this invention had been used had higher speeds than Samples e, f and g which had been prepared using the comparative emulsions and, moreover, the toe gradation was of higher contrast and it had an excellent resistance to pressure of a similar order to that of Sample e.

TABLE 7

| Layer | Principal Composition | Amount Used |
|---|---|---|
| Seventh Layer (Protective Layer) | Gelatin | 1.33 g/m² |
| | Acrylic modified polymer of polyvinyl alcohol (17% modification) | 0.17 g/m² |
| Sixth Layer (Ultraviolet Absorbing layer) | Gelatin | 0.54 g/m² |
| | Ultraviolet absorber (j) | 0.21 g/m² |
| | Solvent (l) | 0.09 cc/m² |
| Fifth Layer (Red Sensitive Layer) | Silver chlorobromide emulsion | 0.24 g/m² |
| | Gelatin | 0.96 g/m² |
| | Cyan coupler (s) | 0.2 g/m² |
| | Cyan coupler (t) | 0.2 g/m² |
| | Colored image stabilizer (n) | 0.17 g/m² |
| | Solvent (l) | 0.1 cc/m² |
| | Solvent (c) | 0.2 cc/m² |
| Fourth Layer (Ultraviolet Absorbing Layer) | Gelatin | 1.60 g/m² |
| | Ultraviolet absorber (j) | 0.62 g/m² |
| | Anti-color mixing agent (k) | 0.05 g/m² |
| | Solvent (l) | 0.26 cc/m² |
| Third Layer (Green Sensitive Layer) | Silver chlorobromide emulsion | 0.45 g/m² |
| | Gelatin | 1.00 g/m² |

TABLE 7-continued

| Layer | Principal Composition | Amount Used |
|---|---|---|
| | Magenta coupler (p) | 0.35 $g/m^2$ |
| | Colored image stabilizer (g) | 0.05 $g/m^2$ |
| | Colored image stabilizer (q/f) | 0.05/0.10 $g/m^2$ |
| | Solvent (r) | 0.45 $cc/m^2$ |
| Second Layer | Gelatin | 0.99 $g/m^2$ |
| (Anti-Color Mixing Layer) | Anti-color mixing agent (d) | 0.08 $g/m^2$ |
| First Layer | Silver chlorobromide emulsion | 0.30 $g/m^2$ |
| (Blue Sensitive Layer) | Gelatin | 1.20 $g/m^2$ |
| | Yellow coupler (o) | 0.70 $g/m^2$ |
| | Solvent (l) | 0.15 $cc/m^2$ |
| Support | Polyethylene laminated paper (With white pigment ($TiO_2$) and | |

TABLE 7-continued

| Layer | Principal Composition | Amount Used |
|---|---|---|
| | ultramarine dye in the polyethylene on the first layer side) | |

The amount of silver chlorobromide emulsion coated is indicated as the value calculated as silver.

(o) Yellow Coupler

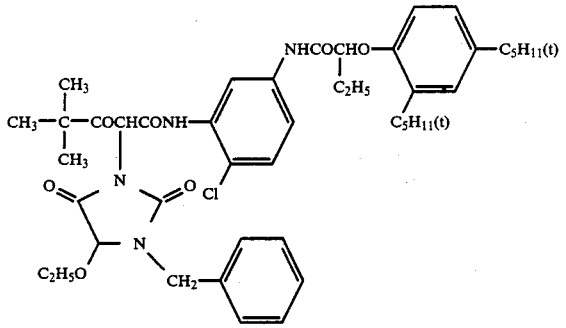

(p) Magenta Coupler

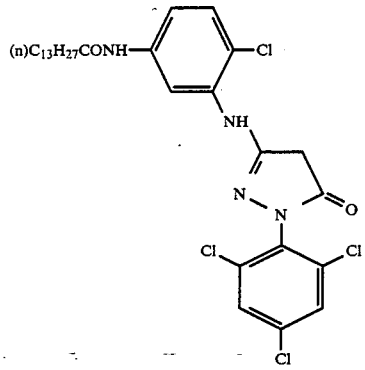

(q) Colored Image Stabilizer

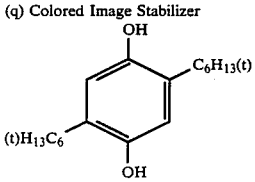

(r) Solvent $(C_8H_{17}O\rightarrow_3 P{=}O$ (s) Cyan Coupler

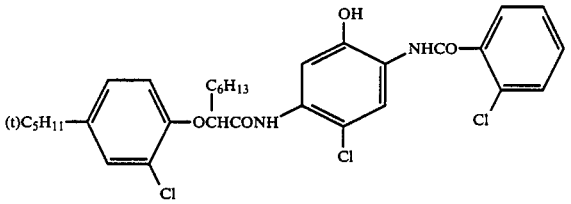

(t) Cyan Coupler

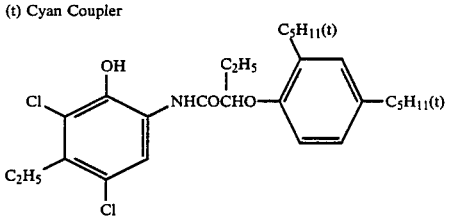

TABLE 8

| Sample | Sensitive Layer Blue | Green | Red | Remarks |
|---|---|---|---|---|
| e | Emulsion P | Emulsion A | Emulsion A | Comparative Example |
| f | Emulsion Q | Emulsion B | Emulsion B | Comparative Example |

TABLE 8-continued

| Sample | Sensitive Layer Blue | Green | Red | Remarks |
|---|---|---|---|---|
| g | Emulsion R | Emulsion G | Emulsion G | Comparative Example |
| h | Emulsion S | Emulsion H | Emulsion H | This |

TABLE 8-continued

| Sample | Sensitive Layer Blue | Green | Red | Remarks |
|---|---|---|---|---|
| | | | | Invention |

It is clear from the results obtained in the examples that it is possible by means of this invention to obtain high speed emulsions without invoking adverse effects such as a softening of toe gradation or a worsening of the pressure properties. Consequently, it is possible to provide silver halide photographic materials which have the excellent performance which has been greatly desired in the past.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising:

a support having thereon at least one emulsion layer containing surface latent image type mono-disperse silver chlorobromide emulsions consisting of silver chlorobromide which is free of silver iodide;

where said silver chlorobromide emulsions are obtained by subjecting the surface of silver halide grains, which have a plurality of layers and which have different halogen compositions within the grains, to halogen conversion;

wherein the difference in the proportions of silver bromide contained in the layer closest to the surface and the layer immediately inside this layer is about 5 mol% to 40 mol% of the whole grain; and wherein the composition of silver halide grains obtained after halogen conversion is such that the silver bromide content is at least 20 mol%.

2. The silver halide photographic material as claimed in claim 1, wherein the proportion of the layer which is closest to the surface from among the plurality of layers which have different halogen compositions within the grain at the stage before the surface is subjected to halogen conversion is from 1 mol% to 99 mol% of the whole grain.

3. The silver halide photographic material as claimed in claim 2, wherein the proportion of the layer which is closest to the surface from among the plurality of layers which have different halogen compositions within the grain at the stage before the surface is subjected to halogen conversion is from 10 mol% to 90 mol% of the whole grain.

4. The silver halide photographic material as claimed in claim 1, wherein the difference in the proportions of silver bromide contained in the layer closest to the surface and the layer immediately inside this layer is about 12 mol% to 30 mol% of the whole grain.

5. The silver halide photographic material as claimed in claim 1, wherein the average grain size before halogen conversion is from about 0.1 $\mu$ to 2 $\mu$.

6. The silver halide photographic material as claimed in claim 5, wherein the average grain size before halogen conversion is from about 1.5 $\mu$ to 1 $\mu$.

7. The silver halide photographic material as claimed in claim 1, wherein the extent of the halogen conversion is 0.5 mol% to 20 mol% with respect to total silver halide.

8. The silver halide photographic material as claimed in claim 7, wherein the extent of the halogen conversion is 1 mol% to 15 mol% with respect to total silver halide.

9. The silver halide photograph,:c material as claimed in claim 1, wherein the composition of silver halide grains obtained after halogen conversion is such that the silver bromide content is at least 40 mol%.

10. The silver halide photographic material as claimed in claim 9, wherein the composition of silver halide grains obtained after halogen conversion is such that the silver bromide content is at least 50 mol%.

* * * * *